US012064038B2

(12) United States Patent
Liu

(10) Patent No.: US 12,064,038 B2
(45) Date of Patent: Aug. 20, 2024

(54) CRIB FRAME

(71) Applicant: WONDERLAND SWITZERLAND AG, Steinhausen (CH)

(72) Inventor: Kaiqin Liu, Guangdong (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 52 days.

(21) Appl. No.: 17/575,203

(22) Filed: Jan. 13, 2022

(65) Prior Publication Data

US 2022/0218121 A1 Jul. 14, 2022

(30) Foreign Application Priority Data

Jan. 14, 2021 (CN) ..... 202110051158.1

(51) Int. Cl.
*A47D 13/06* (2006.01)

(52) U.S. Cl.
CPC ..... *A47D 13/063* (2013.01)

(58) Field of Classification Search
CPC ..... A47D 9/00; A47D 9/005; A47D 9/012; A47D 11/00; A47D 11/005; A47D 11/007; A47D 13/06; A47D 13/061; A47D 13/063; A47D 13/065; A47D 13/068
See application file for complete search history.

(56) References Cited

U.S. PATENT DOCUMENTS 5,615,427 A * 4/1997 Huang ..... A47D 13/063 5/98.1
2003/0061658 A1* 4/2003 Longenecker ..... A47D 13/063 5/99.1
2009/0315008 A1* 12/2009 Yu ..... A47D 13/063 256/67
2009/0320205 A1* 12/2009 Chen ..... A47D 13/063 5/99.1
2013/0074257 A1* 3/2013 Mendes ..... F16C 11/10 16/349
2014/0075670 A1 3/2014 Crumrine
2015/0007387 A1* 1/2015 Lo ..... A47D 13/063 5/98.1

(Continued)

FOREIGN PATENT DOCUMENTS

CN 2722750 Y 9/2005
CN 107518685 A 12/2017

(Continued)

*Primary Examiner* — David R Hare
*Assistant Examiner* — George Sun
(74) *Attorney, Agent, or Firm* — HAUPTMAN HAM, LLP

(57) ABSTRACT

A crib frame includes a first handrail member, a first handrail joint, a second handrail member, a second handrail joint, an engaging member and an unlock member. The engaging member is movably disposed in the first handrail joint. An engaging end of the engaging member engages with the first handrail joint and the second handrail joint, such that the first handrail member and the second handrail member are locked at a handrail unfolding position. The unlock member is movably disposed in the second handrail joint. When the unlock member is pressed, the unlock member pushes the engaging end, such that the engaging end disengages from the second handrail joint, and the first handrail member and the second handrail member are able to rotate with respect to each other.

11 Claims, 4 Drawing Sheets

(56) References Cited

U.S. PATENT DOCUMENTS

| | | | | |
|---|---|---|---|---|
| 2015/0196135 | A1* | 7/2015 | Longenecker | A47D 13/063<br>403/53 |
| 2017/0172311 | A1* | 6/2017 | Longenecker | A47D 13/061 |
| 2017/0280892 | A1* | 10/2017 | Zhang | A47D 13/063 |
| 2017/0290444 | A1* | 10/2017 | Mao | A47D 13/063 |
| 2018/0146796 | A1* | 5/2018 | Longenecker | A47D 9/005 |
| 2019/0246812 | A1 | 8/2019 | Saint et al. | |
| 2020/0077807 | A1* | 3/2020 | Taylor | A47D 13/063 |
| 2020/0352351 | A1* | 11/2020 | Mountz | A47D 9/005 |

FOREIGN PATENT DOCUMENTS

| | | | |
|---|---|---|---|
| CN | 109330274 | A | 2/2019 |
| CN | 110881811 | A | 3/2020 |
| CN | 210623379 | U | 5/2020 |
| CN | 212272813 | U | 1/2021 |
| TW | M297204 | U | 9/2006 |

* cited by examiner

CRIB FRAME

FIELD

The application relates to a crib frame and, more particularly, to a crib frame with convenient operation and simple structure.

BACKGROUND

For a caregiver, a crib is a practical tool for taking care of infants or children. The crib provides rest or entertainment space for infants or children. In general, a conventional crib frame includes four pillars and four handrails, wherein each handrail is connected between two pillars to form a closed space within the crib frame. To reduce space occupied by the crib for purposes of shipment and storage, most of the crib frames are foldable so far, such that the size of the crib frame can be reduced after being folded.

DETAILED DESCRIPTION

Figure 1:
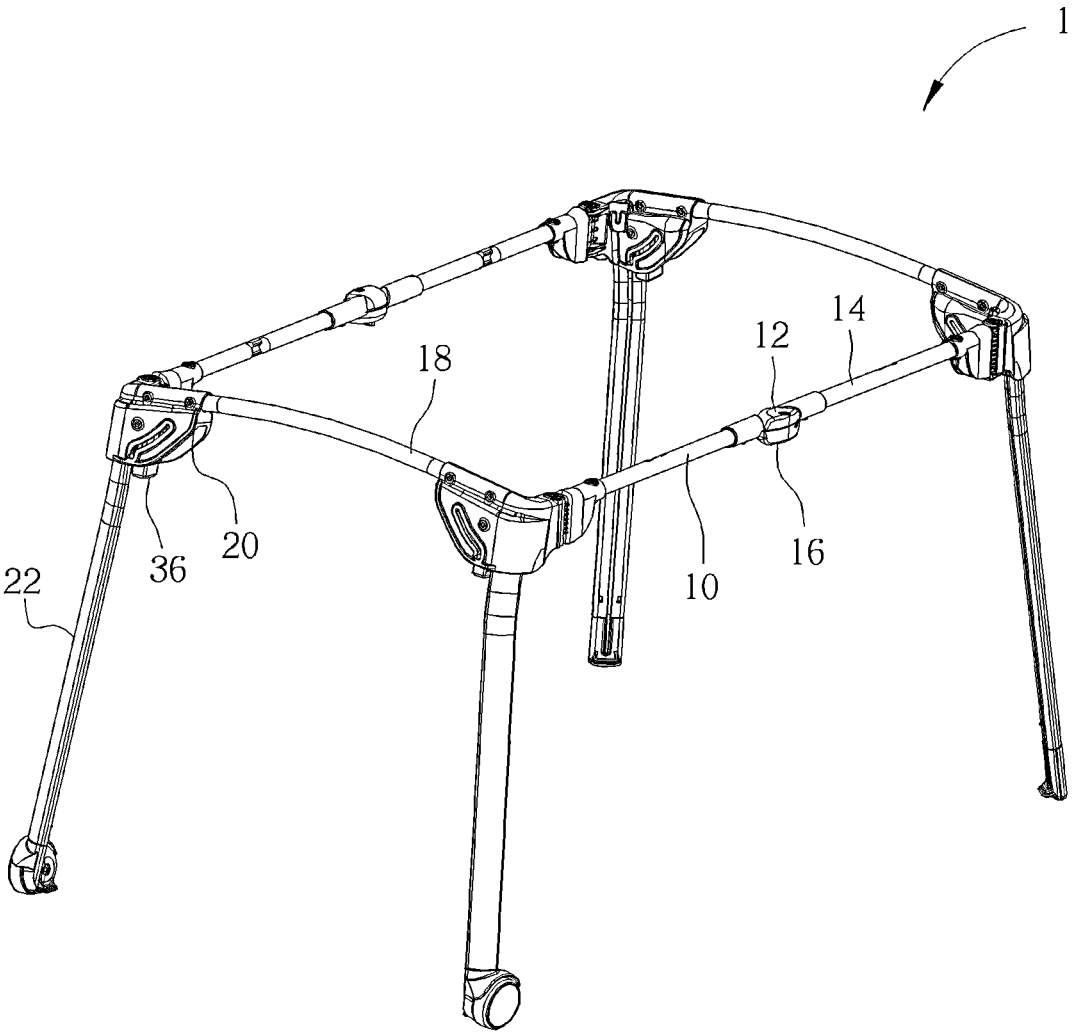
FIG. 1 is a perspective view illustrating a crib frame according to an embodiment of the application.

Referring to FIG. 1, FIG. 1 is a perspective view illustrating a crib frame 1 according to an embodiment of the application.

As shown in FIG. 1, the crib frame 1 of the application includes a first handrail member 10, a first handrail joint 12, a second handrail member 14 and a second handrail joint 16. In this embodiment, the crib frame 1 may include two first handrail members 10, two first handrail joints 12, two second handrail members 14 and two second handrail joints 16, which are respectively disposed at opposite sides of the crib frame 1. The first handrail joint 12 is connected to the first handrail member 10, the second handrail joint 16 is connected to the second handrail member 14, and the first handrail joint 12 is pivotally connected to the second handrail joint 16. Accordingly, the first handrail member 10 and the second handrail member 14 can be unfolded or folded with respect to each other through the pivoting of the first handrail joint 12 and the second handrail joint 16.

As shown in FIG. 1, the crib frame 1 of the application further includes a third handrail member 18, a socket 20 and a support member 22. The third handrail member 18 may be connected to one of the first handrail member 10 and the second handrail member 14 by the socket 20. In this embodiment, the crib frame 1 may include two third handrail members 18, four sockets 20 and four support members 22. The two third handrail members 18 are connected to the two first handrail members 10 and the two second handrail members 14 by the four sockets 20, so as to form a closed space. Each of the support members 22 is pivotally connected to the corresponding socket 20, such that the support member 22 can be unfolded or folded with respect to the socket 20. The crib frame 1 can stand on a plane by the unfolded support members 22.

Figure 2:
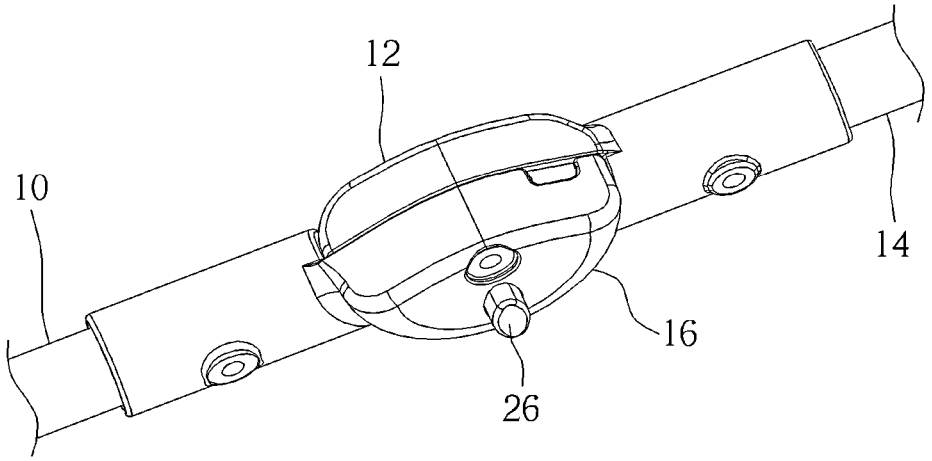
FIG. 2 is an enlarged view illustrating the first handrail joint and the second handrail joint shown in FIG. 1.
Figure 3:
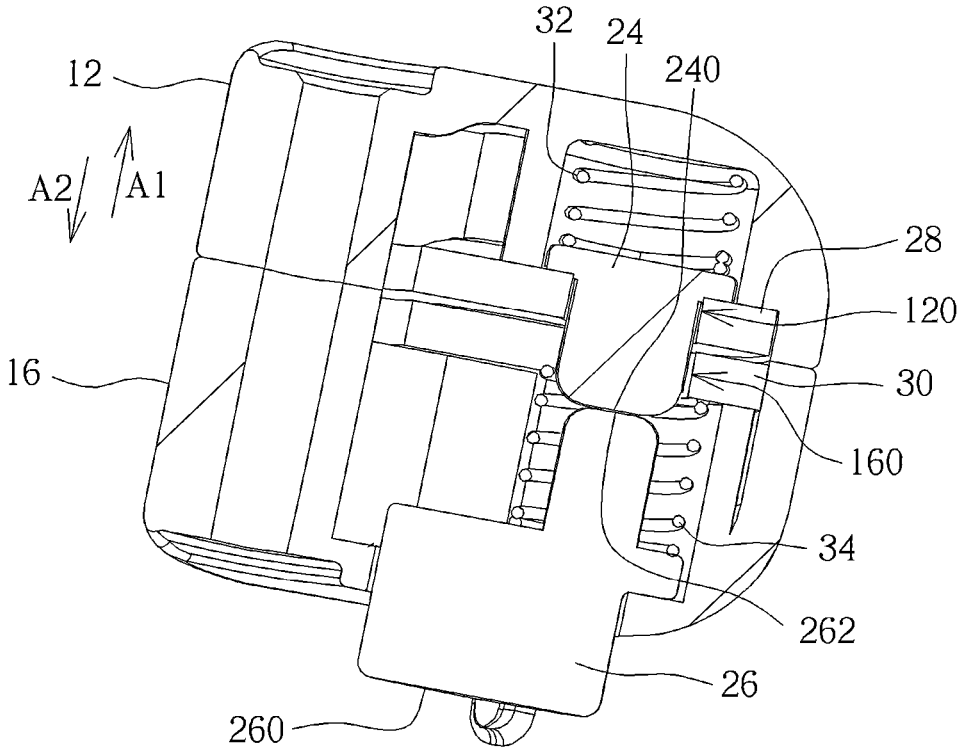
FIG. 3 is a sectional view illustrating the first handrail joint and the second handrail joint shown in FIG. 2.
Figure 4:
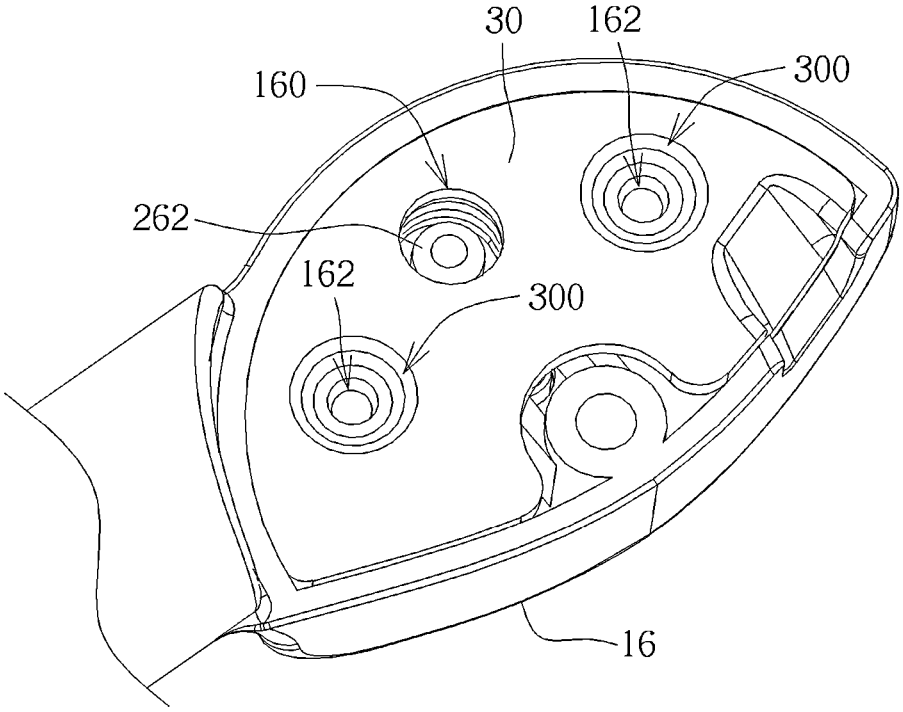
FIG. 4 is a perspective view illustrating the second handrail joint and the second reinforcing member shown in FIG. 3.

Referring to FIGS. 2 to 4, FIG. 2 is an enlarged view illustrating the first handrail joint 12 and the second handrail joint 16 shown in FIG. 1, FIG. 3 is a sectional view illustrating the first handrail joint 12 and the second handrail joint 16 shown in FIG. 2, and FIG. 4 is a perspective view illustrating the second handrail joint 16 and the second reinforcing member 30 shown in FIG. 3.

As shown in FIGS. 2 and 3, the crib frame 1 of the application further includes an engaging member 24 and an unlock member 26. The engaging member 24 is movably disposed in the first handrail joint 12. An engaging end 240 of the engaging member 24 engages with the first handrail joint 12 and the second handrail joint 16, such that the first handrail member 10 and the second handrail member 14 are locked at a handrail unfolding position (as shown in FIG. 1). In this embodiment, the first handrail joint 12 has a first through hole 120 and the second handrail joint 16 has a second through hole 160, wherein the first through hole 120 is aligned with the second through hole 160. The engaging end 240 of the engaging member 24 extends into the first through hole 120 and the second through hole 160 to engage with the first handrail joint 12 and the second handrail joint 16. In this embodiment, the crib frame 1 further includes a first reinforcing member 28 and a second reinforcing member 30. The first reinforcing member 28 is disposed in the first handrail joint 12 and the first through hole 120 is formed on the first reinforcing member 28. The second reinforcing member 30 is disposed in the second handrail joint 16 and the second through hole 160 is formed on the second reinforcing member 30. As shown in FIG. 4, the second handrail joint 16 may have two screw holes 162 and the second reinforcing member 30 may have two through holes 300, wherein the two screw holes 162 are aligned with the two through holes 300. The application may fasten two screws (not shown) to the two screw holes through the two through holes, so as to fasten the second reinforcing member 30 to the second handrail joint 16. It should be noted that the first reinforcing member 28 may also be fastened to the first handrail joint 12 by the aforesaid manner and the repeated explanation will not be depicted herein again.

As shown in FIG. 3, the unlock member 26 is movably disposed in the second handrail joint 16. A press end 260 of the unlock member 26 is exposed out of the second handrail joint 16 and a push end 262 of the unlock member 26 abuts against the engaging end 240 of the engaging member 24. In this embodiment, the crib frame 1 further includes a first elastic member 32 and a second elastic member 34. The first elastic member 32 is disposed in the first handrail joint 12, wherein opposite ends of the first elastic member 32 abut against the engaging member 24 and the first handrail joint 12 respectively. The second elastic member 34 is disposed in the second handrail joint 16, wherein opposite ends of the second elastic member 34 abut against the unlock member 26 and the second reinforcing member 30 respectively. The first elastic member 32 and the second elastic member 34 may be, but not limited to, springs.

When the first handrail member 10 and the second handrail member 14 need to be folded, a user may press the press end 260 of the unlock member 26 toward a direction of an arrow A1. When the press end 260 of the unlock member 26 is pressed, the push end 262 of the unlock member 26 pushes the engaging end 240 of the engaging member 24 toward the direction of the arrow A1, such that the engaging end 240 of the engaging member 24 disengages from the second handrail joint 16. At this time, the engaging member 24 compresses the first elastic member 32 toward the direction of the arrow A1 and the unlock member 26 compresses the second elastic member 34 toward the direction of the arrow A1. When the engaging end 240 of the engaging member 24 disengages from the second handrail joint 16, the first handrail member 10 and the second handrail member 14 are able to rotate with respect to each other from the handrail unfolding position shown in FIG. 1 to a handrail folding position (not shown), so as to fold the first handrail member 10 and the second handrail member 14. When the user releases the unlock member 26, an elastic force provided by the second elastic member 34 returns the unlock member 26 toward a direction of an arrow A2. Furthermore, when the first handrail member 10 and the second handrail member 14 rotate with respect to each other from the handrail unfolding position to the handrail folding position, the first through hole 120 is aligned with the second through hole 160. At this time, an elastic force provided by the first elastic member 32 returns the engaging member 24 toward the direction of the arrow A2, such that the engaging end 240 of the engaging member 24 extends into the first through hole 120 and the second through hole 160 to engage with the first handrail joint 12 and the second handrail joint 16.

Figure 5:
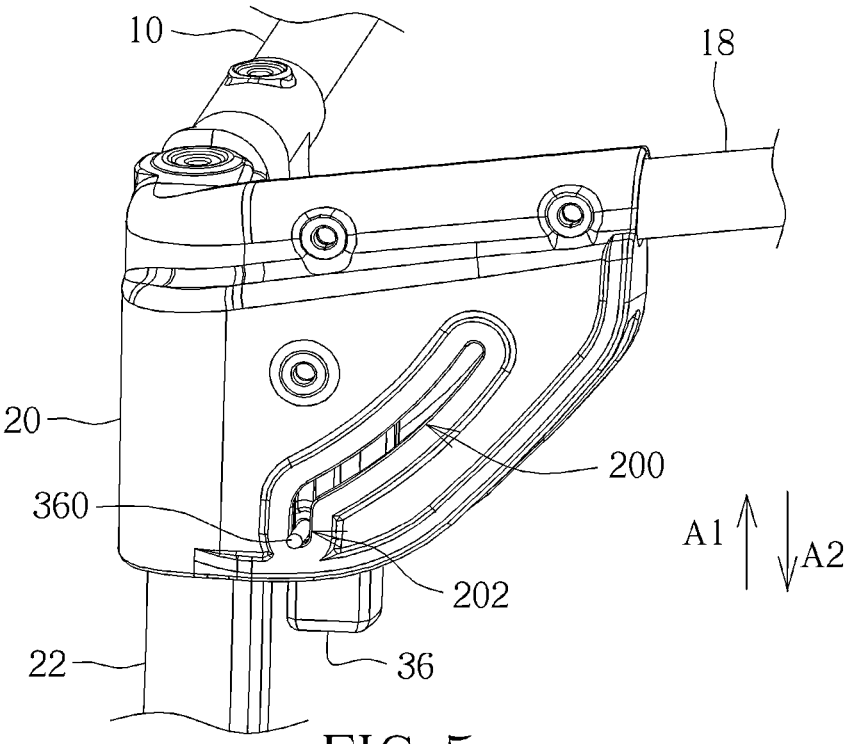
FIG. 5 is an enlarged view illustrating the socket shown in FIG. 1.
Figure 6:
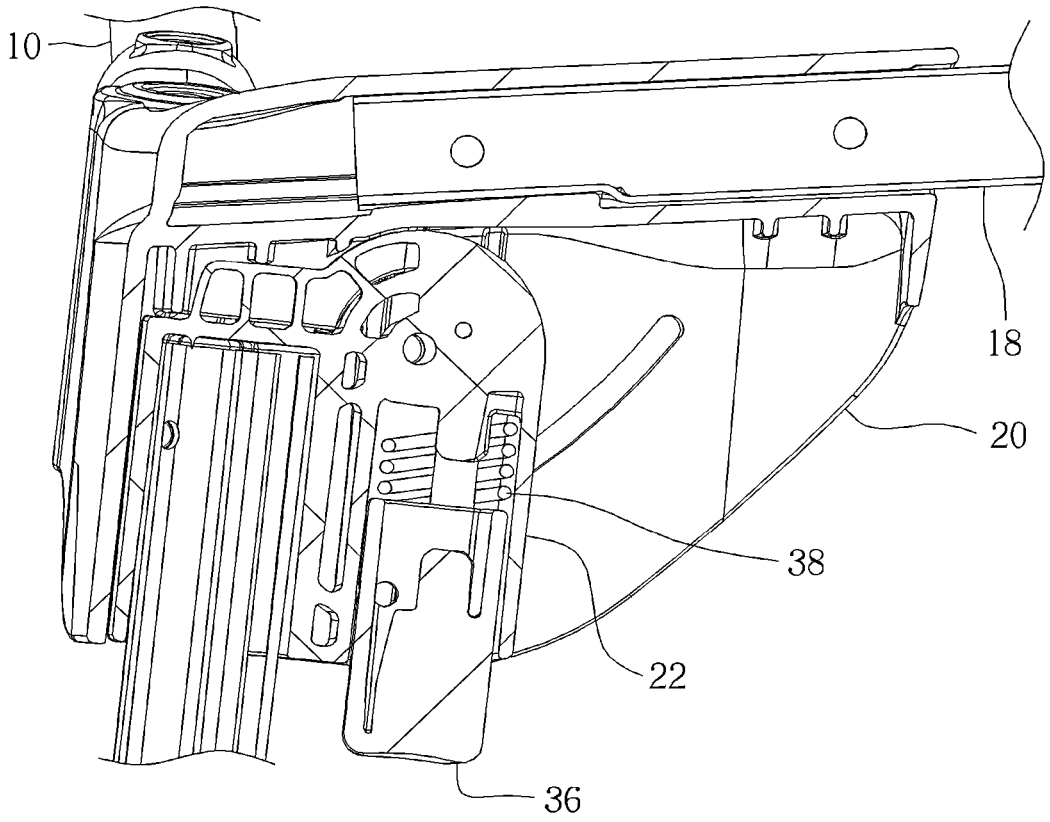
FIG. 6 is a sectional view illustrating the socket shown in FIG. 5.

Referring to FIGS. 5 and 6, FIG. 5 is an enlarged view illustrating the socket 20 shown in FIG. 1 and FIG. 6 is a sectional view illustrating the socket 20 shown in FIG. 5.

As shown in FIGS. 5 and 6, the crib frame 1 further includes an operating member 36. In this embodiment, the socket 20 has a sliding groove 200 and a positioning groove 202, wherein the sliding groove 200 communicates with the positioning groove 202. In this embodiment, the sliding groove 200 is arc-shaped. The operating member 36 is movably disposed on the support member 22. An end of the operating member 36 is exposed out of the support member 22. The operating member 36 has a positioning portion 360. As shown in FIG. 5, when the positioning portion 360 of the operating member 36 is located in the positioning groove 202 of the socket 20, the support member 22 is locked at a support member unfolding position. As shown in FIG. 6, the crib frame 1 further includes a third elastic member 38 disposed in the support member 22, wherein opposite ends of the third elastic member 38 abut against the operating member 36 and the support member 22 respectively. The third elastic member 38 may be, but not limited to, a spring. When the support member 22 needs to be folded, the user may press the operating member 36 toward the direction of the arrow A1. When the operating member 36 is pressed, the positioning portion 360 of the operating member 36 moves from the positioning groove 202 of the socket 20 to the sliding groove 200, such that the support member 22 is able to rotate along the sliding groove 200 from the support member unfolding position shown in FIG. 5 to a support member folding position (not shown), so as to fold the support member 22. When the operating member 36 is pressed, the operating member 36 compresses the third elastic member 38 toward the direction of the arrow A1. When the support member 22 rotates along the sliding groove 200, the positioning portion 360 of the operating member 36 abuts against an edge of the sliding groove 200, such that the third elastic member 38 is kept in a compressed state. When the support member 22 rotates along the sliding groove 200 from the support member folding position to the support member unfolding position, an elastic force provided by the third elastic member 38 returns the operating member 36 toward the direction of the arrow A2, such that the positioning portion 360 of the operating member 36 is engaged into the positioning groove 202, so as to position the support member 22 at the support member unfolding position.

The folding structure of a conventional crib frame is complicated and the operation is inconvenient. It is undoubtedly a trouble for the caregiver. The crib frame of the application utilizes the engaging end of the engaging member to engage with the first handrail joint and the second handrail joint, such that the first handrail member and the second handrail member are locked at the handrail unfolding position. When the first handrail member and the second handrail member need to be folded, a user may press the press end of the unlock member. When the press end of the unlock member is pressed, the push end of the unlock member pushes the engaging end of the engaging member, such that the engaging end of the engaging member disengages from the second handrail joint. At this time, the first handrail member and the second handrail member are able to rotate with respect to each other from the handrail unfolding position to the handrail folding position, so as to fold the first handrail member and the second handrail member. Furthermore, when the positioning portion of the operating member is located in the positioning groove of the socket, the support member is locked at the support member unfolding position. When the support member needs to be folded, the user may press the operating member. When the operating member is pressed, the positioning portion of the operating member moves from the positioning groove of the socket to the sliding groove, such that the support member is able to rotate from the support member unfolding position to the support member folding position, so as to fold the support member. Accordingly, the user can easily fold the crib frame of the application. The crib frame of the application is not only convenient to operate, but also simple in structure.

Those skilled in the art will readily observe that numerous modifications and alterations of the device and method may be made while retaining the teachings of the application. Accordingly, the above disclosure should be construed as limited only by the metes and bounds of the appended claims.

What is claimed is:

1. A crib frame comprising:

a first handrail member;

a first handrail joint connected to the first handrail member;

a second handrail member;

a second handrail joint connected to the second handrail member, the first handrail joint being pivotally connected to the second handrail joint;

an engaging member movably disposed in the first handrail joint, an engaging end of the engaging member engaging with the first handrail joint and the second handrail joint, such that the first handrail member and the second handrail member are locked at a handrail unfolding position; and an unlock member movably disposed in the second handrail joint, a press end of the unlock member being exposed out of the second handrail joint, a push end of the unlock member abutting against the engaging end;

wherein when the press end is pressed, the push end pushes the engaging end such that the engaging end disengages from the second handrail joint, and the first handrail member and the second handrail member are able to rotate with respect to each other.

2. The crib frame of claim 1, wherein the first handrail joint has a first through hole, the second handrail joint has a second through hole, and the engaging end extends into the first through hole and the second through hole to engage with the first handrail joint and the second handrail joint.

3. The crib frame of claim 2, wherein the first through hole is aligned with the second through hole.

4. The crib frame of claim 2, further comprising:

a first reinforcing member disposed in the first handrail joint, the first through hole being formed on the first reinforcing member; and a second reinforcing member disposed in the second handrail joint, the second through hole being formed on the second reinforcing member.

5. The crib frame of claim 4, further comprising:

a first elastic member disposed in the first handrail joint, opposite ends of the first elastic member abutting against the engaging member and the first handrail joint respectively; and a second elastic member disposed in the second handrail joint, opposite ends of the second elastic member abutting against the unlock member and the second reinforcing member respectively.

6. The crib frame of claim 1, further comprising:

a socket having a sliding groove and a positioning groove, the sliding groove communicating with the positioning groove;

a support member pivotally connected to the socket; and an operating member movably disposed on the support member, an end of the operating member being exposed out of the support member, and the operating member having a positioning portion;

wherein when the positioning portion is located in the positioning groove, the support member is locked at a support member unfolding position.

7. The crib frame of claim 6, wherein when the operating member is pressed, the positioning portion moves from the positioning groove to the sliding groove, such that the support member is able to rotate along the sliding groove from the support member unfolding position to a support member folding position.

8. The crib frame of claim 6, further comprising an elastic member disposed in the support member, opposite ends of the elastic member abutting against the operating member and the support member respectively.

9. The crib frame of claim 6, wherein the sliding groove is arc-shaped.

10. The crib frame of claim 6, further comprising a third handrail member, the third handrail member being connected to one of the first handrail member and the second handrail member by the socket.

11. A crib frame comprising:

a socket having a sliding groove and a positioning groove, the sliding groove communicating with the positioning groove;

a support member pivotally connected to the socket; and an operating member movably disposed on the support member, an end of the operating member being exposed out of the support member, and the operating member having a positioning portion;

wherein when the positioning portion is located in the positioning groove, the support member is locked at a support member unfolding position, the crib frame further comprises:

a first handrail member;

a first handrail joint connected to the first handrail member;

a second handrail member;

a second handrail joint connected to the second handrail member, the first handrail joint being pivotally connected to the second handrail joint;

an engaging member movably disposed in the first handrail joint, an engaging end of the engaging member engaging with the first handrail joint and the second handrail joint, such that the first handrail member and the second handrail member are locked at a handrail unfolding position; and an unlock member movably disposed in the second handrail joint, a press end of the unlock member being exposed out of the second handrail joint, a push end of the unlock member abutting against the engaging end;

when the press end is pressed, the push end pushes the engaging end such that the engaging end disengages from the second handrail joint, and the first handrail member and the second handrail member are able to rotate with respect to each other, the first handrail joint has a first through hole, the second handrail joint has a second through hole, and the engaging end extends into the first through hole and the second through hole to engage with the first handrail joint and the second handrail joint, the crib frame further comprises:

a first reinforcing member disposed in the first handrail joint, the first through hole being formed on the first reinforcing member; and a second reinforcing member disposed in the second handrail joint, the second through hole being formed on the second reinforcing member, and the crib frame further comprises:

a first elastic member disposed in the first handrail joint, opposite ends of the first elastic member abutting against the engaging member and the first handrail joint respectively; and a second elastic member disposed in the second handrail joint, opposite ends of the second elastic member abutting against the unlock member and the second reinforcing member respectively.

* * * * *